US007165932B2

(12) United States Patent
Yu et al.

(10) Patent No.: US 7,165,932 B2
(45) Date of Patent: Jan. 23, 2007

(54) FUEL PUMP HAVING DUAL SINGLE SIDED IMPELLER

(75) Inventors: DeQuan Yu, Ann Arbor, MI (US); Stephen Thomas Kempfer, Canton, MI (US); Paul Edward Fisher, Brighton, MI (US); Harold Lawrence Castle, Dexter, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 192 days.

(21) Appl. No.: 11/041,485

(22) Filed: Jan. 24, 2005

(65) Prior Publication Data

US 2006/0165514 A1 Jul. 27, 2006

(51) Int. Cl.
*F01D 1/12* (2006.01)

(52) U.S. Cl. ..... 415/55.7

(58) Field of Classification Search ..... 415/55.1, 415/55.2, 55.3, 55.4, 55.5, 55.6, 55.7
See application file for complete search history.

(56) References Cited

U.S. PATENT DOCUMENTS

| | | | | |
|---|---|---|---|---|
| 803,759 | A | | 11/1905 | Herles et al. |
| 2,464,144 | A | | 3/1949 | McConaghy |
| 3,867,062 | A | | 2/1975 | Troller |
| 3,881,839 | A | | 5/1975 | MacManus |
| 3,951,567 | A | | 4/1976 | Rohs |
| 3,957,389 | A | | 5/1976 | Rafferty et al. |
| 4,556,363 | A | * | 12/1985 | Watanabe et al. ..... 415/55.6 |
| 4,923,365 | A | | 5/1990 | Rollwage |
| 5,009,575 | A | | 4/1991 | Hanai et al. |
| 5,149,252 | A | | 9/1992 | Tuckey et al. |
| 5,336,045 | A | | 8/1994 | Koyama et al. |
| 5,435,691 | A | | 7/1995 | Braun et al. |
| 5,456,574 | A | | 10/1995 | Donnelly et al. |
| 5,605,443 | A | | 2/1997 | Schoning et al. |
| 5,702,229 | A | | 12/1997 | Moss et al. |
| 5,938,412 | A | | 8/1999 | Izraelev |
| 6,132,185 | A | | 10/2000 | Wilhelm |
| 6,152,688 | A | | 11/2000 | Staab et al. |
| 6,162,012 | A | | 12/2000 | Tuckey et al. |
| 6,179,579 | B1 | | 1/2001 | Dobler et al. |
| 6,425,377 | B1 | | 7/2002 | Marx et al. |
| 6,425,734 | B2 | | 7/2002 | Marx |
| 6,443,693 | B1 | | 9/2002 | Eck |
| 6,468,051 | B2 | | 10/2002 | Lampe et al. |
| 6,471,466 | B2 | | 10/2002 | Marx et al. |

(Continued)

*Primary Examiner*—Edward K. Look
*Assistant Examiner*—Nathan Wiehe
(74) *Attorney, Agent, or Firm*—Brinks, Hofer Gilson & Lione

(57) ABSTRACT

A fuel pump includes a housing, and a motor. A single sided impeller has first and second impeller flow channels each including a plurality of vanes. The impeller defines a flow passageway extending therethrough. A cover is attached to the housing and has a cover surface that defines first and second cover flow channels. The cover flow channels receive fuel from inlets formed in the cover. The first and second cover flow channels are aligned with the first and second impeller flow channels and receive fuel through the inlets and deliver fuel to outlets. A body is positioned within the housing and defines an impeller chamber to receive the impeller, and a first outlet passageway fluidically connected to the first cover flow channel and impeller flow channel. A second outlet passageway formed within the cover is fluidically connected to the second cover flow channel and impeller flow channel.

24 Claims, 6 Drawing Sheets

U.S. PATENT DOCUMENTS

| | | | |
|---|---|---|---|
| 6,517,310 | B2 | 2/2003 | Marx et al. |
| 2003/0231953 | A1 | 12/2003 | Ross |
| 2004/0013514 | A1 | 1/2004 | Englander |
| 2004/0018080 | A1 | 1/2004 | Yu et al. |
| 2004/0023084 | A1 | 2/2004 | Sterchi et al. |
| 2004/0028521 | A1 | 2/2004 | Penzar et al. |

* cited by examiner

FUEL PUMP HAVING DUAL SINGLE SIDED IMPELLER

FIELD OF THE INVENTION

The present invention relates generally to automotive fuel pumps, and more particularly relates to a regenerative fuel pump having a single sided rotary impeller.

BACKGROUND OF THE INVENTION

Regenerative fuel pumps have been widely used in automotive applications because of the low specific speed number (ratio of diameter and flow rate versus pressure), quiet operation, good handling of hot fuel, and durability. These regenerative fuel pumps generally include an impeller rotating on a shaft and positioned within an impeller chamber in the pump. The clearance between the opposing axial sides of the impeller and the corresponding walls of the impeller chamber must be closely regulated to permit the pump to handle fuel at relatively high pressures (i.e. greater than about 2 bar). The impellers are typically double sided impellers, meaning the impellers include vanes on each opposing side which have vanes positioned therein for pressurizing fuel on both sides of the impeller. In this manner, the impellers are relatively well balanced axially to maintain the necessary clearance for pumping high pressure fuel.

One drawback of these fuel pumps is that their wet circle index is relatively high, typically 1.7 or greater. The wet circle index is an index for the pump boundary layer and friction losses. The wet circle index can be defined as the wet circle length versus the flow channel cross-sectional area. That is, the wet circle length is the distance along the perimeter of the flow channel (i.e. circumference of a round flow channel), the follow channel being formed by both the impeller and the structures (e.g. body and cover structures) on opposing sides of the impeller.

Another aspect of fuel systems using this type of fuel pump is that a secondary pump, or a jet pump, must be used to keep fuel supplied to the fuel delivery module, in which the fuel pump is mounted. In these systems, the jet pump keeps fuel supplied to the fuel delivery module, and the fuel pump takes fuel from the fuel delivery module and delivers it to the fuel system of the vehicle.

Accordingly, there exist a need for a fuel pump with robust axial clearance requirements to permit pumping of high pressure fluid in an automotive environment, while at the same time having a lower wet circle index to reduce friction losses and improve the efficiency of the pump without having to use a jet pump to keep the fuel delivery module supplied with fuel.

BRIEF SUMMARY OF THE INVENTION

The present invention provides a fuel pump that improves the pump efficiency by lowering the wet circle index of the pump while maintaining robust axial clearances to meet the demands of an automotive application. One embodiment of the invention includes a fuel pump for pressurizing fuel for delivery to an engine of a motor vehicle. The fuel pump generally comprises a housing, a motor, a single sided impeller, a cover and a body. The provision of a single sided impeller greatly reduces the wet circle index and improves the pump efficiency.

According to more detailed aspects, the motor is situated in the housing and drives a shaft. The impeller is connected to the shaft for rotation as well as for axial translation relative to the shaft. That is, the impeller is free floating on the shaft. The impeller has opposed axially facing surfaces including a body-side surface and a cover-side surface. The cover-side surface defines first and second impeller flow channels that extend circumferentially around the impeller. The impeller further includes a plurality of vanes, each of the first and second impeller flow channels having a portion of the vanes positioned at least partially therein. The second impeller flow channel is positioned radially inward of the first impeller flow channel, and the impeller defines a flow passageway extending therethrough.

The cover includes a cover surface defining first and second cover flow channels extending circumferentially around the cover. The first cover flow channel receives fuel from a first inlet formed in the cover and the second cover flow channel receives fuel from a second inlet formed in the cover. The first cover flow channel is at least partially aligned with the first impeller flow channel and has an inlet end to receive lower pressure fuel and an outlet end to provide higher pressure fuel. The outlet end extends radially inwardly for fluid communication with the flow passageway of the impeller. The second cover flow channel is at least partially aligned with the second impeller flow channel and has an inlet end to receive fuel and an outlet end to provide fuel to a second outlet passageway.

Rotation of the impeller and its vanes pressurizes the lower pressure fuel provided at the inlet ends of the first and second cover flow channels, which is then forced to the outlet ends of the first and second cover flow channels. The impeller includes a flow passageway extending therethrough and in communication with the outlet end of the first cover flow channel. The body defines a first outlet passageway positioned to fluidically connect to the impeller flow passageway, thereby receiving higher pressure fuel for delivery to the engine.

The impeller is free floating on the shaft and is subjected to a cover-side force from fuel in the cover flow channel and the impeller flow channel, as well as a body-side force from fuel in the outlet passageway. The outlet passageway is at least partially exposed to the body side of the impeller, and the exposed area is sized to provide a body-side force, and approximately equal to the cover-side force. In this way, the impeller is balanced on the shaft to provide robust axial clearances for pumping higher pressure fuel.

According to still further details, the exposed area on the body-side of the impeller is less than the area of the cover-side of the impeller exposed to the cover flow channel, as the pressure on the body-side is generally greater than the average pressure on the cover-side of the impeller. Additionally, one or both of the body and the cover may define pressure balance channels in fluidic communication with either high or low pressure fuel, which can be adjusted to provide a balanced impeller. The pressure balance channels may take many forms and may be positioned at various radial and circumferential positions.

In this way, the fuel pump of the present invention allows the impeller to maintain an axial clearance between the cover and the impeller that is less than or equal to 50 micron by sizing the area of the cover-side surface of the impeller that is exposed to fluid in relation to the area of the body-side surface of the impeller that is exposed to fuel. Likewise, the impeller maintains an axial clearance between the cover that is sufficient to pressurize fuel to at least 2 bar. Notably, the fuel pump does not require a bearing or other structural component to maintain the necessary clearance between the cover and the impeller.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION

Figure 1:
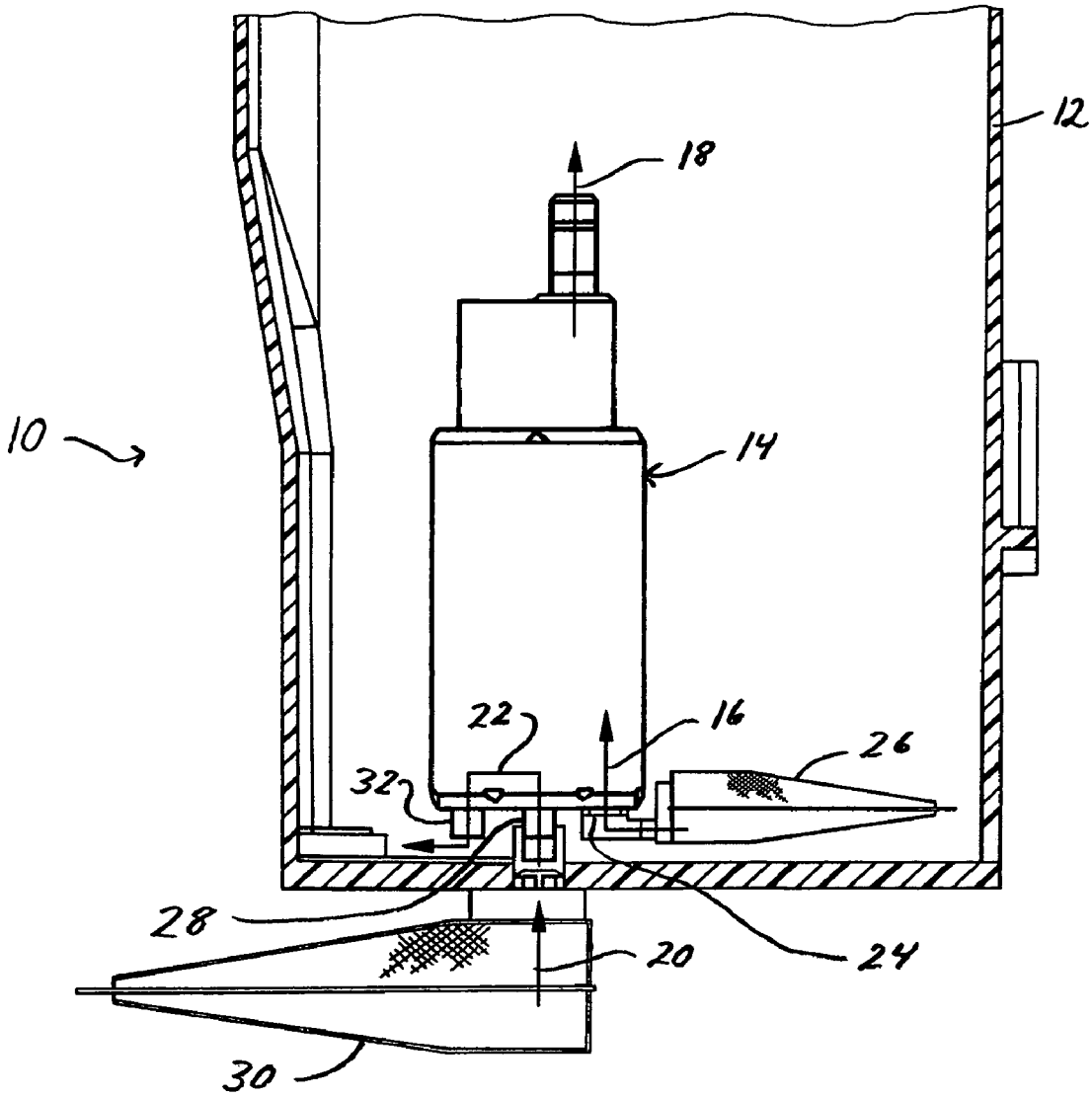
FIG. 1 is a cross-sectional view of a fuel delivery module constructed in accordance with the teachings of the present invention.

Referring to FIG. 1, a fuel delivery module is generally shown at 10. The fuel delivery module 10 is adapted to be mounted within the fuel tank of a motor vehicle and includes a fuel reservoir 12 and a fuel pump 14 mounted within the fuel reservoir. The fuel pump 14 is adapted to pump fuel from within the fuel reservoir 12 into the fuel pump 14 as indicated by arrow 16 and to deliver pressurized fuel to the engine (not shown), as indicated by arrow 18. The fuel pump 14 is also adapted to pump fuel from within the fuel tank, outside of the fuel reservoir 12, into the fuel pump 14, as indicated by arrow 20, and to deliver fuel from the fuel pump 14 into the fuel reservoir 12, as indicated by arrow 22.

Fuel flows from the fuel reservoir 12 into the fuel pump 14 through a first inlet 24. A filter 26 is mounted onto the first inlet 24 to prevent contamination from entering the fuel pump 14 from the fuel reservoir 12. Fuel flows from the fuel tank into the fuel pump 14 through a second inlet 28. A filter 30 is mounted onto the second inlet 28 to prevent contamination from entering the fuel pump 14 from the fuel tank. Fuel flows from the fuel pump 14 into the fuel reservoir 12 through a second outlet passageway 32.

Figure 2:
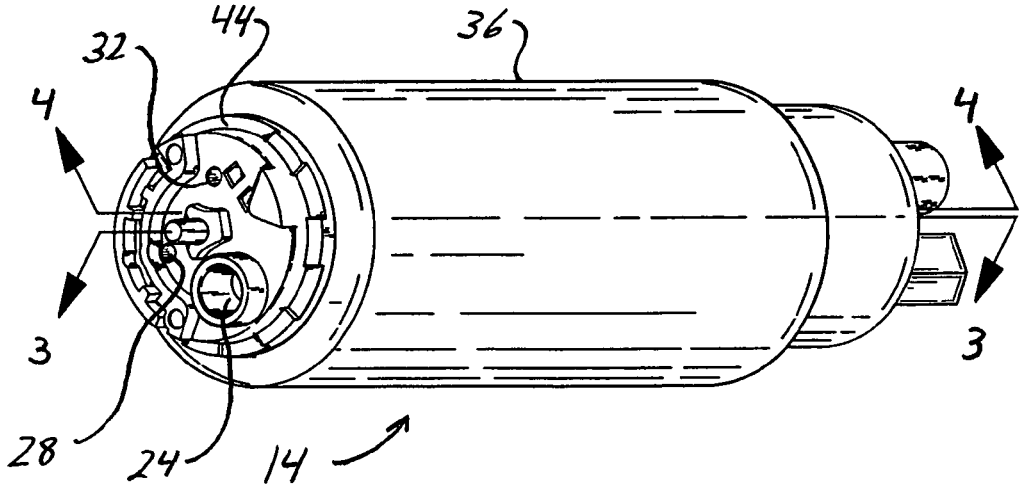
FIG. 2 is a perspective view of the fuel pump shown mounted in the fuel deliver module of FIG. 1.
Figure 3:
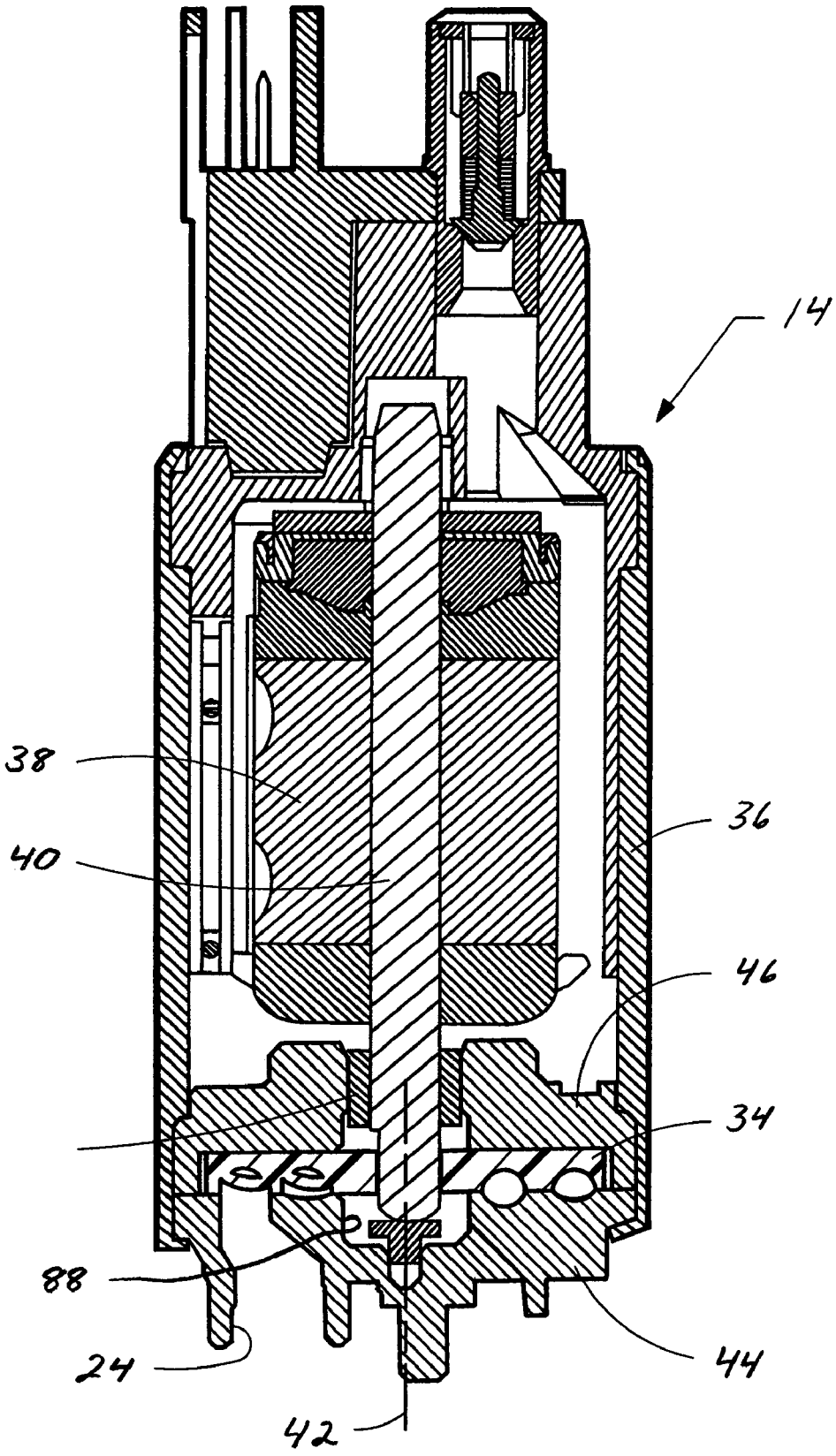
FIG. 3 is a cross sectional view of the pump taken along lines 3—3 of FIG. 2.
Figure 4:
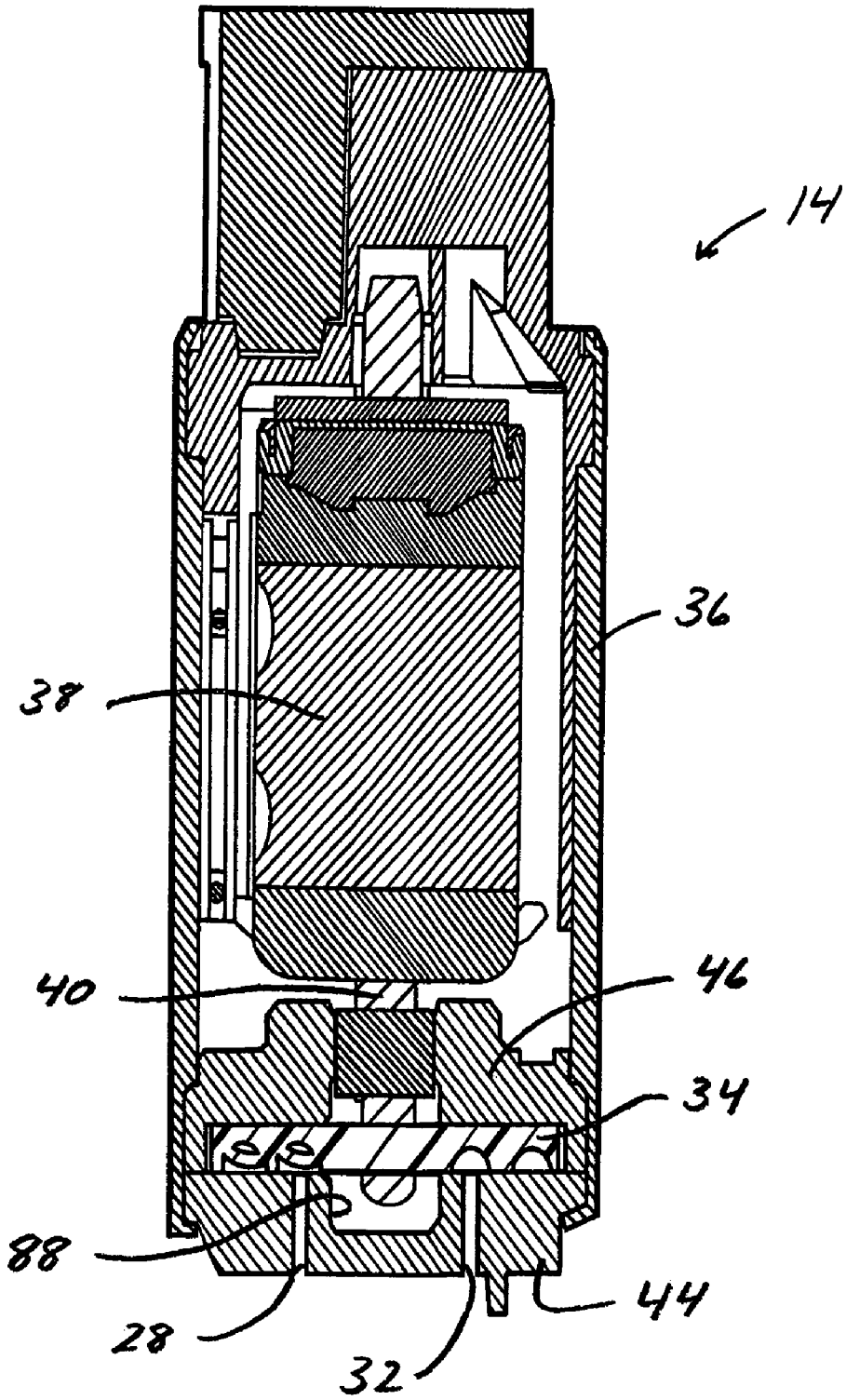
FIG. 4 is a cross sectional view of the pump taken along lines 4—4 of FIG. 2.

FIG. 2 is a perspective view of the fuel pump 14 removed from the fuel delivery module 10. FIGS. 3 and 4 are cross sectional views of the fuel pump 14 that illustrate different features of the fuel pump 14.

Referring to FIG. 3, a cross-sectional view of the fuel pump 14 constructed in accordance with the teachings of the present invention is shown. Notably, the fuel pump 14 includes a single sided impeller 34 which greatly reduces the wet circle index from about 1.8 to about 1.1, thereby reducing friction losses and increasing the hydraulic efficiency of the fuel pump 14 typically about 20%–35%. Furthermore, the single sided impeller 34 is free floating while maintaining an axial clearance that is sufficient to handle fuels at higher pressure, typically about 2 bar or greater.

The fuel pump 14 generally includes a housing 36 which encloses a motor 38 therein. The motor 38 is operatively connected to a shaft 40 which defines a central axis 42 of the pump 14. A cover 44 closes off the open end of the housing 36, and defines the first and second inlets 24, 28 for receiving lower pressure fuel and the second outlet passageway 32. The first inlet 24 is shown in FIG. 3 and the second inlet 28 and second outlet passageway 32 are shown in FIG. 4. A body 46 is positioned inside the housing 36 and inside the cover 44. The impeller 34 is fitted between the cover 44 and the body 46. The impeller 34 is fitted on,the shaft 40 for rotation, as well as axial translation relative to the shaft 40. That is, the impeller 34 is free floating on the shaft 40 as previously mentioned.

Figure 5:
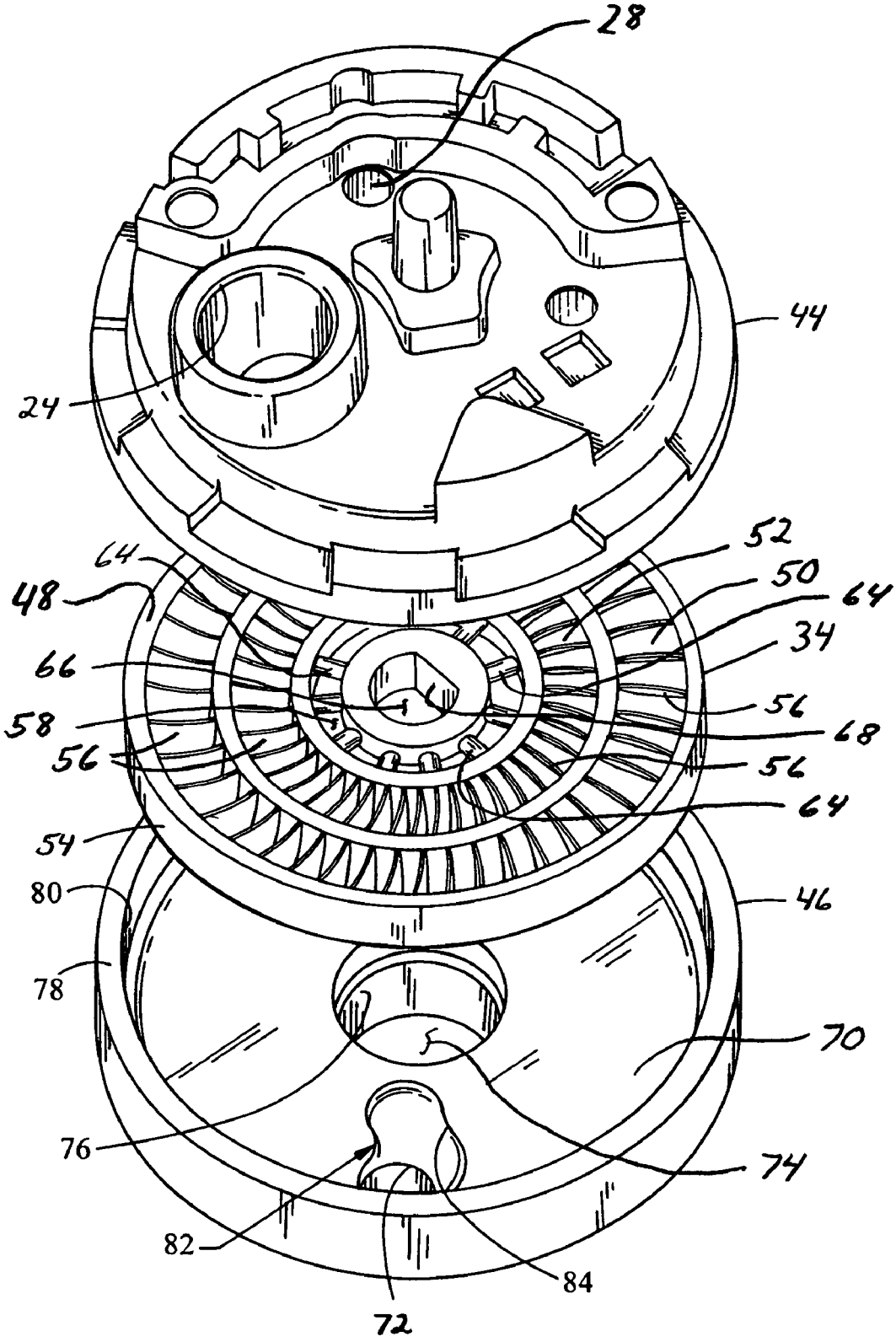
FIG. 5 is an exploded view, in perspective, of the cover, impeller and body forming a portion of the fuel pump depicted in FIG. 2.

Turning now to FIG. 5, an exploded view of the cover 44, impeller 34 and body 46 is shown in perspective. It can be seen that the impeller 34 includes a cover-side surface 48 which defines a first impeller flow channel 50 and a second impeller flow channel 52 therein. The first impeller flow channel 50 extends circumferentially around the impeller 34 and is located adjacent the outer peripheral surface 54 of the impeller 34. The second impeller flow channel 52 extends circumferentially around the impeller 34 and is located radially inward and adjacent the first impeller flow channel 50. Each of the first and second impeller flow channels 50, 52 includes a plurality of vanes 56 which are used to pressurize the fuel, as is known in the art. As shown, the radial widths of the first and second impeller flow channels 50, 52 are substantially equal, however, it should be understood that the invention could be practiced wherein the radial width of the first and second impeller flow channels 50, 52 are not substantially equal.

An impeller flow passageway 58 extends through the impeller 34 from the cover-side surface 48 to a body-side surface 60 (FIG. 6), opposite the cover-side surface 48. The impeller flow passageway 58 is defined by a plurality of circumferentially spaced apertures 62 aligned in an annular configuration as shown. The apertures 62 are separated by a plurality of spokes 64 having a circular cross-section to facilitate fluid flow. It will also be recognized by those skilled in the art that the spokes 64 can have other cross-sectional shapes different than circular, such as oval, elliptical, flat, curved or vane-shaped, which can vary along the length of the spoke 64. Non-circular or vane-shaped spokes 64 will supplement the pumping action of the fuel pump 14. It can also be seen that the impeller 34 includes an aperture 66 which includes a flat 68 for receiving the shaft 40 which rotatably drives the impeller 34.

The body 46 generally includes a body surface 70 facing axially towards the impeller 34. The body 46 defines a first outlet 72 through which pressurized fuel flows for ultimate delivery to the engine. The body 46 also defines a central aperture 74 and a bearing surface 76 through which the shaft 40 extends for connection to the impeller 34. The body 46 includes a peripheral rim 78 which defines an impeller chamber 80 therein. That is, the peripheral rim 78 and the body surface 70 define an impeller chamber 80 that is sized to receive the impeller 34, as best seen in FIGS. 3 and 4. Finally, the body 46 defines a first outlet passageway 82 which is fluidically connected to the first outlet 72. The first outlet passageway 82 is at least partially defined by a recess 84 formed in the body surface 70. It can be seen that the recess 84 extends radially inwardly from the first outlet 72 and has a figure-eight or hour-glass shape.

Figure 6:
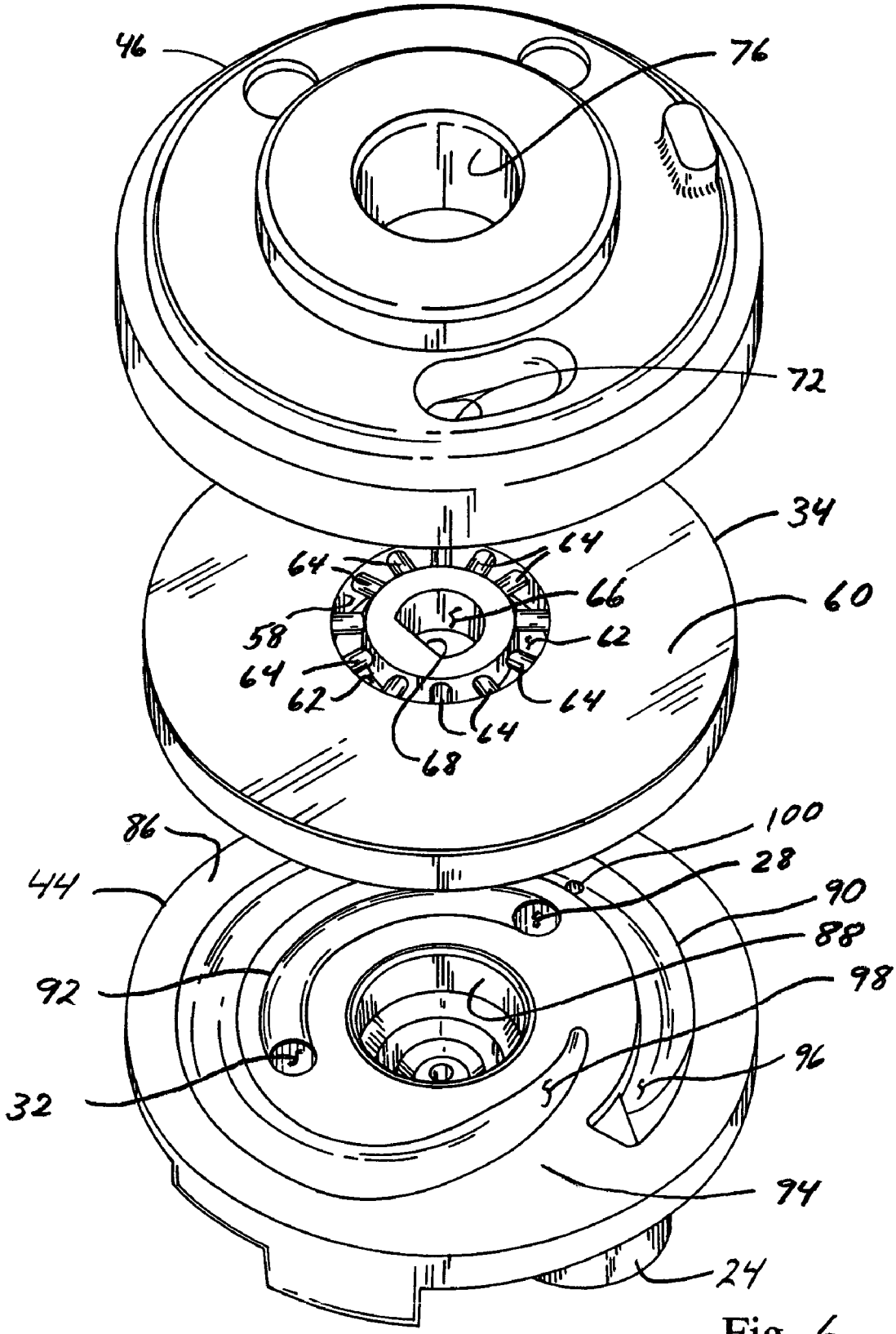
FIG. 6 is an exploded view, in perspective, similar to FIG. 5 but showing the opposing sides of the cover, impeller and body.

The opposing sides of the cover 44, impeller 34 and body 46 are shown in the exploded view of FIG. 6. The cover 44 includes a cover surface 86 facing axially towards the impeller 34. The cover surface 86 defines a recess 88 which is sized to receive the shaft 40 and a thrust button as shown in FIGS. 3 and 4. The cover surface 86 also defines first and second cover flow channels 90, 92 which extend circumferentially around the cover 44.

The first cover flow channel 90 is radially aligned with the first impeller flow channel 50 and its vanes 56 (FIG. 5) for pressurizing fuel therein. The first cover flow channel 90 extends around the cover 44 about 330° before turning radially inward, thereby leaving a strip area 94 between the ends of the first cover flow channel 90. The second cover flow channel 92 is radially aligned with the second impeller flow channel 52 and its vanes 56 (FIG. 5) for pressurizing fuel therein. It will also be recognized from FIG. 6 that the body side surface 60 of the impeller 34 does not include any vanes or flow channels, the impeller 34 thus being single sided.

Figure 7:
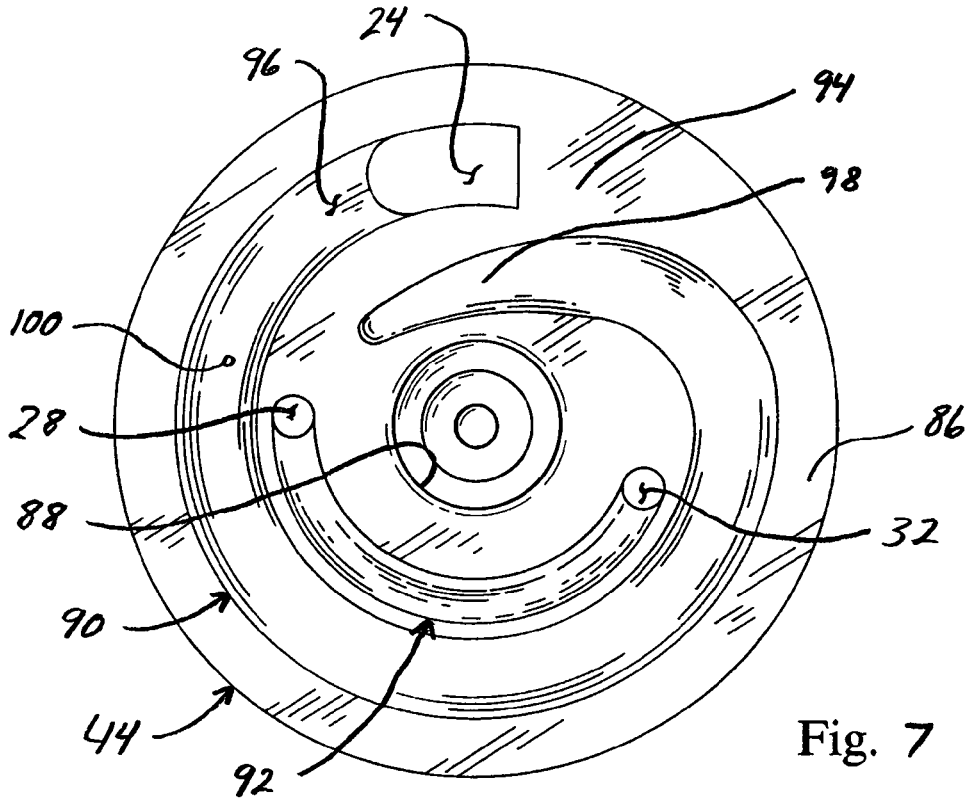
FIG. 7 is an enlarged perspective view of the cover depicted in FIG. 6.

An enlarged view of the cover 44 is shown in FIG. 7. In particular, the first cover flow channel 90 can be seen, which includes an inlet end 96 and an outlet end 98. Fuel enters the first cover flow channel 90 through the first inlet 24 and exits the first cover flow channel 90 near the outlet end 98 through the impeller flow passageway 58. Additionally, the first cover flow channel 90 includes a vapor vent hole 100 which is utilized to vent unwanted fuel vapors from the fuel pump 14. The outlet end 98 of the first cover flow channel 90 turns and extends radially inwardly, which will be discussed in further detail below. Fuel enters the second cover flow channel 92 through the second inlet 28 and exits the second cover flow channel 92 through the second outlet passageway 32.

When assembled together as shown, the cover 44 and body 46 sandwich the impeller 34 therebetween, the impeller 34 being positioned within the impeller chamber 80 defined by the peripheral rim 78 of the body 46. Lower pressure fuel is received through the second inlet 28. The second inlet 28 extends axially and communicates with the second cover flow channel 92. The second cover flow channel 92 is radially aligned with the second impeller flow channel 52 formed in the impeller 34. Fuel thus flows into the second cover flow channel 92 and second impeller flow channel 52, which is pressurized by the vanes 56 of the second impeller flow channel 52 and the rotation of the impeller 34 relative to the stationary cover 44 and body 46. Thus, fuel is pumped from the fuel tank, and into the fuel reservoir 12 via the second impeller flow channel 52 and the second cover flow channel 92.

At the same time, lower pressure fuel is received from the fuel reservoir 12 through the first inlet 24. The first inlet 24 extends axially and communicates with the inlet end 96 of the first cover flow channel 90. The first cover flow channel 90 is radially aligned with the first impeller flow channel 50 formed in the impeller 34. Fuel thus flows into the first cover flow channel 90 and first impeller flow channel 50, which is pressurized by the vanes 56 and the rotation of the impeller 34 relative to the stationary cover 44 and body 46. Thus, fuel is pumped from the fuel reservoir 12 to the engine of the vehicle via the first impeller flow channel 50 and the first cover flow channel 90.

The fuel is pressurized as it flows from the inlet end 96 to the outlet end 98 of the first cover flow channel 90. As shown in FIG. 6, the outlet end 98 of the first cover flow channel 90 turns and extends radially inwardly to a position aligned with the impeller flow passageway 58. The first outlet passageway 82 defined by the body 46 is fluidically connected to the impeller flow passageway 58. In this way, higher pressure fuel is allowed to flow through the impeller 34, through the first outlet passageway 82 and into the first outlet 72 defined in the body 46.

Accordingly, by way of the present invention, a more efficient fuel pump 14 is provided by the provision of a single sided impeller 34. The first cover flow channel 90 and the first impeller flow channel 50 are sized to provide a fuel pump 14 which is capable of pumping the same volume of fluid as a comparable pump having a double sided impeller, while at the same time employing a single sided impeller 34 that reduces the wet circle index, and hence losses to friction. Additionally, the second cover flow channel 92 and second impeller flow channel 52 provide a pump which is capable of pumping fuel from the fuel tank into the fuel reservoir 12, thereby eliminating the need for an additional jet pump.

However, a predetermined clearance must be maintained between the impeller 34 and the cover 44 and body 46. In particular, the application of the fuel pump 14 to a motor vehicle requires that the fuel is pressurized to a relatively high level, namely about 2 bar or above. Thus, an axial clearance of about 50 micron (or 0.05 mm) or less must be maintained between the impeller 34 and the cover 44 and body 46. That is, the cover-side surface 48 of the impeller 34 must be maintained within 50 micron (axially) of the cover surface 86 of the cover 44 to be capable of pressurizing fuel to 2 bar or greater.

Unfortunately, the impeller 34 cannot be fixed on the shaft 40. In the harsh environment of a motor vehicle, the fuel pump 14 will be subjected to continuous and repeated operation which causes wear on the thrust button supporting the shaft 40. Thus, over the life of the fuel pump 14, the shaft 40 may shift its position, making it impossible to maintain the ideal clearance between the impeller 34 and the cover 44. Thus, the automotive environment of the fuel pump 14 requires the impeller 34 to be free floating on the shaft 40.

Therefore, the fuel pump 14 according to the teachings of present invention regulates the area of the impeller 34, and in particular the area of the body-side surface 60, that is exposed to the higher pressure fuel in the first outlet passageway 82. In particular, the area of the impeller 34 which is exposed to fuel on its body side 60 is closely sized relative to the area of the cover-side 48 of the impeller 34 which is exposed to fluid. It will be recognized that the area of the impeller 34 which is exposed to fluid on its cover-side surface 48 is defined by the axially facing area of the first and second cover flow channels 90, 92. It will also be recognized that the pressure of fluid in the first and second cover flow channels 90, 92 varies from the inlets 24, 28 to the outlets 32, 72. Thus, the pressure of the fluid in the first and second cover flow channels 90, 92 must be averaged, and for purposes here can be generalized as approximately one half of the change in pressure from the inlets 24, 28 to the outlets 32, 72.

For example, if lower pressure fluid is provided at the inlet end 96 at about 0 bar, and is pressurized by the fuel pump 14 to a pressure of about 4 bar at the outlet end 98, the average pressure in the first cover flow channel 90 can be estimated to be 2 bar. In this example, the higher pressure fuel in the first outlet passageway 82 of the body 46 is thus also about 4 bar. Accordingly, the area of the impeller 34 (and in particular the body side surface 60) which is exposed to the first outlet passageway 82 is controlled in relation to the exposed area corresponding to the first cover flow passageway 90, thereby providing a generally balanced force on opposing sides of the impeller 34. Stated another way, the impeller 34 is subject to a cover-side force and a body-side force, which are designed to be approximately equal.

As used herein, the terms about, approximately, generally and the like, when used in relation to the forces and pressures on the impeller 34, encompass the fact that the actual pressure within the first and second cover flow channels 90, 92 may vary depending upon particular conditions (e.g. pulsations or other pressure variations) which in turn causes the opposing axial forces on the impeller 34 to vary, which in turn causes the impeller 34 to float on the shaft 40, and is known in the art. In this way, the impeller 34 is allowed to translate axially along the shaft 40 to accommodate pressure variations, while at the same time maintaining an appropriate axial clearance of about 50 micron or less to ensure the ability of the pump to pressurize fuel to high pressure, namely about 2 bar or greater.

The foregoing description of the embodiments described herein has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A fuel pump for a motor vehicle, the fuel pump pressurizing fuel for delivery to an engine, the fuel pump comprising:

a housing;

a motor situated in the housing and driving a shaft, the shaft defining a central axis;

a single sided impeller connected to the shaft for rotation and for axial translation relative to shaft, the impeller having opposed axially facing surfaces including a body-side surface and a cover-side surface;

the cover-side surface defining first and second impeller flow channels extending circumferentially around the impeller, the impeller further including a plurality of vanes, each of the first and second impeller flow channels having a portion of the vanes positioned at least partially therein, the second impeller flow channel being positioned radially inward of the first impeller flow channel, the impeller defining a flow passageway extending through the impeller;

a cover attached to the housing;

the cover having a cover surface defining first and second cover flow channels extending circumferentially around the cover, the first cover flow channel receiving fuel from a first inlet formed in the cover and the second cover flow channel receiving fuel from a second inlet formed in the cover, the first cover flow channel at least partially aligned with the first impeller flow channel and having an inlet end receiving lower pressure fuel and an outlet end providing higher pressure fuel, the outlet end extending radially inwardly for fluid communication with the flow passageway of the impeller, and the second cover flow channel at least partially aligned with the second impeller flow channel and having an inlet end receiving fuel and an outlet end providing fuel to a second outlet passageway;

a body defined inside the housing, the body defining an impeller chamber having a body surface, the impeller chamber sized to receive the impeller, the body further defining a first outlet passageway positioned to fluidically connect to the flow passageway of the impeller to receive higher pressure fuel for delivery to the engine.

2. The fuel pump of claim 1, wherein the impeller flow passageway is positioned radially inwardly from the first and second impeller flow channels.

3. The fuel pump of claim 1, wherein the outlet passageway extends radially outwardly to an outlet formed in the body.

4. The fuel pump of claim 1, wherein the impeller's flow passageway extends from the cover-side surface to the body-side surface.

5. The fuel pump of claim 1, wherein the impeller's flow passageway is comprised of a plurality of circumferentially spaced apertures.

6. The fuel pump of claim 5, wherein the plurality of apertures are spaced apart by a plurality of spokes.

7. The fuel pump of claim 6, wherein each spoke is vane-shaped.

8. The fuel pump of claim 6, wherein each spoke has an upstream surface and a downstream surface, the upstream surface having a tapered shape to facilitate fluid flow.

9. The fuel pump of claim 1, wherein the impeller maintains an axial clearance between the cover-side surface and the cover surface that is less than or equal to 50 micron by sizing the area of the cover-side surface of the impeller that is exposed to fuel in relation to the area of the body-side surface of the impeller that is exposed to fuel.

10. The fuel pump of claim 1, wherein the impeller maintains an axial clearance between the cover-side surface and the cover surface that is sufficient to pressurize fuel to at least 2 bar by sizing the area of the cover-side surface of the impeller that is exposed to fuel in relation to the area of the body-side surface of the impeller that is exposed to fuel.

11. The fuel pump of claim 1, wherein the fuel pump does not include a bearing or other structural component limiting the clearance between the cover-side surface of the impeller and the cover surface of the cover.

12. The fuel pump of claim 1 wherein the first and second impeller flow channels have substantially equal radial widths.

13. A fuel delivery module adapted to be mounted within the fuel tank of a motor vehicle comprising:

a fuel delivery reservoir;

a fuel pump having a housing mounted within the fuel delivery reservoir;

a motor situated in the housing and driving a shaft, the shaft defining a central axis of the fuel pump;

a single sided impeller connected to the shaft for rotation and for axial translation relative to shaft, the impeller having opposed axially facing surfaces including a body-side surface and a cover-side surface;

the cover-side surface defining first and second impeller flow channels extending circumferentially around the impeller, the impeller further including a plurality of vanes, each of the first and second impeller flow channels having a portion of the vanes positioned at least partially therein, the second impeller flow channel being positioned radially inward of the first impeller flow channel, the impeller defining a flow passageway extending through the impeller;

a cover attached to the housing;

the cover having a cover surface defining first and second cover flow channels extending circumferentially around the cover, the first cover flow channel receiving fuel from a first inlet formed in the cover and the second cover flow channel receiving fuel from a second inlet formed in the cover, the first cover flow channel at least partially aligned with the first impeller flow channel and having an inlet end receiving lower pressure fuel and an outlet end providing higher pressure fuel, the outlet end extending radially inwardly for fluid communication with the flow passageway of the impeller, and the second cover flow channel at least partially aligned with the second impeller flow channel and having an inlet end receiving fuel and an outlet end providing fuel to a second outlet passageway;

a body defined inside the housing, the body defining an impeller chamber having a body surface, the impeller chamber sized to receive the impeller, the body further defining a first outlet passageway positioned to fluidically connect to the flow passageway of the impeller to receive higher pressure fuel for delivery to the engine;

the first inlet in fluid communication with the fuel delivery reservoir such that the first impeller flow channel is supplied with fuel from within the fuel delivery reservoir and the second inlet extending outside of the fuel delivery reservoir such that the second impeller flow channel is supplied with fuel from within the fuel tank of the motor vehicle, the second outlet passageway in fluid communication with the fluid delivery reservoir such that fuel is delivered from the fuel tank to the fuel delivery reservoir through the second impeller flow channel.

14. The fuel delivery module of claim 13, wherein the impeller flow passageway is positioned radially inwardly from the first and second impeller flow channels.

15. The fuel delivery module of claim 13, wherein the outlet passageway extends radially outwardly to an outlet formed in the body.

16. The fuel delivery module of claim 13, wherein the impeller's flow passageway extends from the cover-side surface to the body-side surface.

17. The fuel delivery module of claim 13, wherein the impeller's flow passageway is comprised of a plurality of circumferentially spaced apertures.

18. The fuel delivery module of claim 17, wherein the plurality of apertures are spaced apart by a plurality of spokes.

19. The fuel delivery module of claim 18, wherein each spoke is vane-shaped.

20. The fuel delivery module of claim 18, wherein each spoke has an upstream surface and a downstream surface, the upstream surface having a tapered shape to facilitate fluid flow.

21. The fuel delivery module of claim 13, wherein the impeller maintains an axial clearance between the cover-side surface and the cover surface that is less than or equal to 50 micron by sizing the area of the cover-side surface of the impeller that is exposed to fuel in relation to the area of the body-side surface of the impeller that is exposed to fuel.

22. The fuel delivery module of claim 13, wherein the impeller maintains an axial clearance between the cover-side surface and the cover surface that is sufficient to pressurize fuel to at least 2 bar by sizing the area of the cover-side surface of the impeller that is exposed to fuel in relation to the area of the body-side surface of the impeller that is exposed to fuel.

23. The fuel delivery module of claim 13, wherein the fuel pump does not include a bearing or other structural component limiting the clearance between the cover-side surface of the impeller and the cover surface of the cover.

24. The fuel delivery module of claim 13 wherein the first and second impeller flow channels have substantially equal radial widths.

* * * * *